US007920810B2

(12) United States Patent
Oron et al.

(10) Patent No.: US 7,920,810 B2
(45) Date of Patent: Apr. 5, 2011

(54) ELECTROPHOTOGRAPHY DEVICE WITH ELECTRIC FIELD APPLICATOR

(75) Inventors: Gadi Oron, Rehovot (IL); Dror Kella, Nes-Ziona (IL); Eran Gonen, Nir David (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 856 days.

(21) Appl. No.: 11/839,027

(22) Filed: Aug. 15, 2007

(65) Prior Publication Data

US 2009/0047587 A1 Feb. 19, 2009

(51) Int. Cl.
*G03G 15/00* (2006.01)
*G03G 21/00* (2006.01)

(52) U.S. Cl. ..... 399/156; 399/128; 399/159; 430/97

(58) Field of Classification Search ..... 399/156, 399/153, 159, 2, 128, 169, 252; 430/97, 430/104, 125.1
See application file for complete search history.

(56) References Cited

U.S. PATENT DOCUMENTS 3,830,645 A * 8/1974 Zweig ..... 430/97
3,967,891 A * 7/1976 Rippstein ..... 399/156
3,997,259 A * 12/1976 Bhagat ..... 399/156
4,529,292 A 7/1985 Ohseto
4,757,345 A * 7/1988 Ohashi et al. ..... 399/128
4,827,306 A 5/1989 Tsujimoto et al.
4,954,843 A * 9/1990 Oka et al. ..... 399/156
4,974,026 A 11/1990 Maruyama
5,130,215 A 7/1992 Adley et al.
5,164,276 A 11/1992 Robinson et al.
5,450,189 A 9/1995 Russell et al.
5,476,604 A 12/1995 Nguyen
5,518,853 A 5/1996 Nguyen et al.
5,557,377 A 9/1996 Loewen et al.
5,606,398 A * 2/1997 Ender ..... 399/153 X
5,666,591 A 9/1997 Taya
5,666,608 A 9/1997 Christensen
5,713,066 A 1/1998 Takekoshi et al.
5,784,668 A 7/1998 Hyakutake et al.
5,805,956 A 9/1998 Kawai et al.
5,821,019 A 10/1998 Nguyen
5,960,236 A * 9/1999 Zaman et al. ..... 399/159 X
5,994,013 A 11/1999 Levin et al.
6,184,914 B1 2/2001 Hoberock et al.
6,347,209 B1 2/2002 Bessho
6,591,072 B2 7/2003 Hashimoto et al.
6,741,827 B2 5/2004 Lee
6,832,059 B2 12/2004 Fujiwara
(Continued)

FOREIGN PATENT DOCUMENTS

EP 0549867 A2 7/1993
EP 615177 B1 5/1999
JP 2002123141 A 4/2002
JP 2002-333747 A 11/2002
JP 2004333765 A 11/2004
WO 2006090352 A1 8/2006

OTHER PUBLICATIONS

International Search Report And Written Opinion of the International Searching Authority, PCT/US2008/072656, Mailing Date—Mar. 12, 2009.

*Primary Examiner* — Sophia S Chen

(57) ABSTRACT

Embodiments of an electrophotography device are disclosed.

24 Claims, 5 Drawing Sheets

U.S. PATENT DOCUMENTS

| | | | |
|---|---|---|---|
| 6,952,546 | B2 | 10/2005 | Yoshikawa |
| 6,987,939 | B2 | 1/2006 | Ishiyama et al. |
| 2001/0024580 | A1 | 9/2001 | Kusunose |
| 2003/0231899 | A1 | 12/2003 | Yamamura |
| 2004/0005158 | A1 | 1/2004 | Okubo et al. |
| 2005/0074249 | A1 | 4/2005 | Nishimura |
| 2006/0083527 | A1 | 4/2006 | Sakamaki |
| 2007/0148573 | A1 * | 6/2007 | Mishra et al. ..... 399/159 X |

* cited by examiner

ELECTROPHOTOGRAPHY DEVICE WITH ELECTRIC FIELD APPLICATOR

BACKGROUND

The introduction of electrophotography revolutionized the handling of printed information. With the mere click of a button, a copy can be made onto paper or other recording media. This convenience has led to electrophotography devices becoming an indispensable part of the home and office landscape. However, while electrophotography is commonplace, some conventional electrophotography devices are too slow, costly, and/or too bulky.

DETAILED DESCRIPTION

In the following detailed description, reference is made to the accompanying drawings which form a part hereof, and in which is shown by way of illustration specific embodiments in which the subject matter of the present disclosure may be practiced. In this regard, directional terminology, such as "top," "bottom," "front," "back," "leading," "trailing," etc., is used with reference to the orientation of the Figure(s) being described. Because components of embodiments of the present disclosure can be positioned in a number of different orientations, the directional terminology is used for purposes of illustration and is in no way limiting. It is to be understood that other embodiments may be utilized and structural or logical changes may be made without departing from the scope of the present disclosure. The following detailed description, therefore, is not to be taken in a limiting sense, and the scope of the present disclosure is defined by the appended claims.

Embodiments of the present disclosure are directed to electrophotography devices tuned to facilitate a faster response from a photoconductor. In one embodiment, an electric field applicator is positioned adjacent to a photoconductor between a light source for exposing a latent image on a photoconductor and a development station for developing the latent image. In other embodiments, the field applicator is positioned between a charging station and the light source or is interposed directly between the light (from the light source) and the photoconductor.

In one aspect, the externally controller field applicator induces a substantially uniform electric field in an outer portion of a photoconductor to quickly drive components (e.g., positive holes) of a charge pair to a top surface of the outer portion of the photoconductor. This arrangement reduces the relaxation period of the photoconductor, while simultaneously using less energy for discharging targeted regions of the photoconductor. This arrangement also reduces unwanted dot gain (of the type associated with slow discharge of a photoconductor), thereby producing sharper images from the electrophotography device. These effects, in turn, facilitate smaller sized electrophotography devices by permitting smaller photoconductors and facilitate more energy efficient electrophotography devices by permitting the use of lower intensity light sources.

In another aspect, the externally controlled electric field enables greater uniformity of the discharge level (caused by the exposure to a light source) regardless of the discharge region size. In one aspect, this arrangement also results in a reduction in the discharge voltage, thereby increasing the longevity of a photoconductor.

These embodiments, and additional embodiments, are described in association with FIGS. 1-11.

Figure 1:
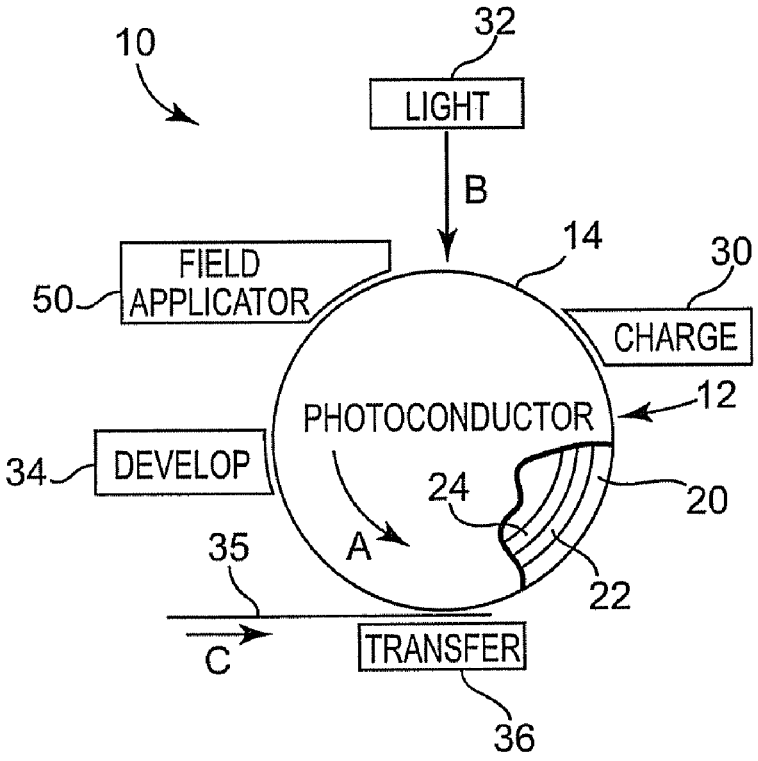
FIG. 1 is a side view illustrating an electrophotography device, according one embodiment of the present disclosure.

FIG. 1 is side plan view illustrating an electrophotography device 10, according to one embodiment of the present disclosure. As illustrated in FIG. 1, device 10 comprises a photoconductor 12, charging station 30, light source 32, development station 34, and transfer station 36. In one aspect, photoconductor 12 comprises a drum or cylinder, which is configured to rotate (as represented by directional arrow A) relative to the charge station 30, light source 32, development station 34, and transfer station 36.

In one embodiment, photoconductor 12 comprises an outer portion 15 that includes outer charge transport layer 20, inner conductive layer 24, and charge generating layer 22 sandwiched between the conductive layer 24 and the outer charge transport layer 20. In one aspect, outer portion 15 comprises a top surface 14 defined by outer charge transport layer 20.

Charging station 30 applies a charge on outer portion 15 of photoconductor 12 and in one embodiment, comprises a corona charger or other known charging devices. Light source 32 comprises a direct light source (e.g., LEDs) or a laser system including directional mirrors to emit a beam of light (as represented by directional arrow B) onto outer portion 15 of photoconductor 12.

In operation, as photoconductor 12 rotates, charging station 30 applies a charge on outer portion 15 of photoconductor 12 and then beam of light (B) from light source 32 exposes the charged outer portion 15 of photoconductor 12 to form a latent image on top surface 14 of photoconductor 12. Development station 34 develops the latent image via application of toner (or charged ink) to the outer surface 14 of photoconductor drum and transfer station 36 acts to transfer the developed image onto medium 35 (e.g., paper) that moves (as represented by directional arrow C) between surface 14 of outer portion 15 of photoconductor 12 and transfer station 36. In one embodiment, a rubber roller or belt is used to facilitate transfer of the developed image from the photoconductor 12 to the paper or other medium.

In one embodiment, device 10 comprises an electric field applicator 50 positioned adjacent outer portion 15 of photoconductor 12 between light source 32 and development station 34. Electric field applicator 50 induces an electric field in the charge transport layer 20 of the photoconductor 12 to draw charges (e.g., positive holes) migrating from charge generation layer 22 toward top surface 14 of outer portion 15 of photoconductor 12, as described more fully in association with FIG. 2.

Figure 2:
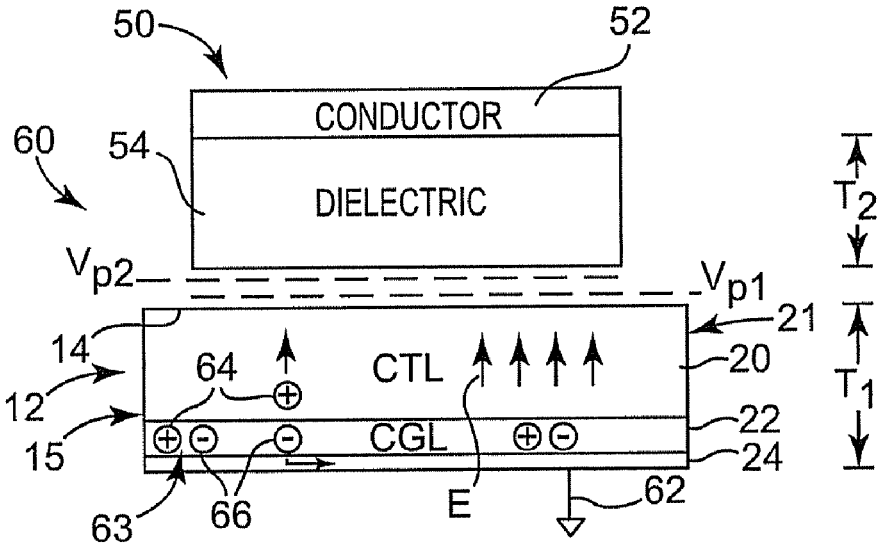
FIG. 2 is a side view illustrating an electric field applicator and a photoconductor of an electrophotography device, according to one embodiment of the present disclosure.

FIG. 2 is a side plan view of an electrophotography device 60, according to one embodiment of the present disclosure. In one embodiment, electrophotography device comprises substantially the same features and attributes as electrophotography device 10 as previously described and illustrated in association with FIGS. 1-2. FIG. 2 illustrates field applicator 50 and a portion of photoconductor 12. As illustrated in FIG. 2, outer portion 15 of photoconductor 12 comprises a dielectric portion 21 and a conductor layer 24 with dielectric portion 21 including the charge generation layer 22 and the charge transport layer 20. In one embodiment, field applicator 50 comprises conductive layer 52 and dielectric layer 54. In one aspect, field applicator 50 is shown in FIG. 2 with a gap between dielectric layer 54 and outer portion 15 of photoconductor 12 for illustrative purposes, with it being understood that dielectric layer 54 of field applicator 50 is actually in contact against outer portion 15 of photoconductor 12, in a manner consistent with embodiments later described and illustrated in association with FIGS. 3-5 and 7-8.

In one aspect, a first negative charge potential (Vp1) is present at top surface 14 of photoconductor 12 due to charging by charging station 30. Upon light (from light source 32) impinging on and exposing outer portion 15 of photoconductor 12, top surface 14 of photoconductor 12 is partially discharged in a pattern to form a latent image. During this exposure, charge pairs are created in charge generation layer 22 with the charge pairs 63 including positive charges 64 and negative charges 66. In one aspect, many of the positive charges 64 (i.e., holes) recombine with the negative charges 66 within dielectric portion 21 while some positive charges 64 migrate toward top surface 14 of outer portion 15 of photoconductor 12 because of the first negative voltage potential (Vp1) at the top surface 14 of photoconductor 12 which attracts the positive charges 64. Positive charges 64 reaching top surface 14 discharge a portion of the charged top surface 14. In another aspect, negative charges 66 that do not recombine with positive charges 64 flow to the ground 62 via conductive layer 24.

In another aspect, FIG. 2 illustrates a second negative voltage (Vp2) applied by field applicator 50 that acts as an externally controlled and independent component to augment the first negative voltage potential (Vp1) originally created by the charges deposited by the charging station 30, thereby strengthening the electric field E, acting to pull the migrating positive charges 64 toward top surface 14 of photoconductor 12.

In one embodiment, dielectric layer 54 of field applicator 50 has a thickness (T2) which is selected as small as possible and at least comparable to (T1) of the dielectric portion 21 of the outer portion 15 of photoconductor 12. This arrangement facilitates keeping the voltage used to maintain the electric field E (in the dielectric portion 21 of photoconductor 12) to be at a sufficient level without resorting to high values of Vp2.

In one embodiment, the electric field E is defined by at least the following parameters: (1) the thickness (T1) of the dielectric portion 21 of photoconductor 12; (2) the thickness (T2) of the dielectric layer 54 of the field applicator 50; (3) the dielectric constant (e1) of the dielectric portion 21 of photoconductor 12; and (4) the dielectric constant (e2) of the dielectric layer 54 of the field applicator 50. Using these parameters, the electric field E created in the outer portion 15 of photoconductor 12 by field applicator 50 is given by the equation Vp2/(T1+(e1/e2)T2).

In one embodiment, using these same notations, the total electric field E in the dielectric portion 21 of photoconductor 12 is expressed as:

$$E = \frac{e_2 V_{p2} + \rho_s T_2}{e_1 T_2 + e_2 T_1},$$

where $\rho_s$ is the surface charge density deposited by the charging station 30.

With this relationship, the gain to the electric field E caused by the action of field applicator 50 (compared to surface charging alone via charging station 30) immediately after exposure of photoconductor 12 to field applicator 50 is expressed as:

$$E = \frac{e_2}{e_1} \times \frac{e_1 V_{p2} - \rho_s T_1}{e_1 T_2 + e_2 T_1}.$$

Accordingly, the effect of the original charge caused by the charging station 30 (as represented by first negative voltage potential Vp1) and of the second negative voltage (Vp2) applied by the field applicator 50 on the dielectric portion 21 of photoconductor 12 is represented by a surface charge distribution $\rho_s$ on charge transport layer 20, which adds up an external potential driving the electric field E. The field E generated by field applicator 50 provides a generally consistent attractive force regardless of the number of, or speed at which, positive charges 64 reach top surface 14 of photoconductor 12, and therefore the electric field E induced by the externally controlled field applicator 50 generally does not dissipate over time.

Moreover, because the electric field E generated by the second voltage (Vp2) applied via the field applicator 50 in combination with the original charge (represented by first negative voltage potential Vp1) provides a stronger attractive force than the first negative voltage potential (Vp1) alone, more positive charges 64 are pulled to top surface 14 of photoconductor 12 before they have a chance to re-combine with negative charges 66 in the charge generation layer 22. In addition, the positive charges 64 pulled to top surface 14 of photoconductor 12 are pulled faster than without the field applicator 50, thereby reducing transit time for the positive charges 64. This reduced transit time, in turn, reduces the time taken to discharge the top surface 14 of the photoconductor 12 in the pattern of the desired latent image. Together, these effects caused by field applicator 50 result in a sharper latent images on surface 14 of photoconductor 12 as well as a substantial reduction in the relaxation time between light exposure of the photoconductor 12 (at light source 32) and development of the latent image at development station 34. In one embodiment, a relaxation time is reduced to about one-half the conventional relaxation time. In another embodiment, the relaxation time is reduced more than one-half the conventional relaxation time when higher voltages are applied by the field applicator 50.

In addition, this arrangement also results in a reduction in the amount of light needed to discharge the outer portion 15 of the photoconductor 12, thereby reducing the size and cost of the light source 32. Moreover, by using less light over a shorter time period, this arrangement also uses less energy, making electrophotography device 60 more energy efficient.

In another aspect, this external electric field (E) also pulls deeper positive charges 64 up to top surface 14 of photoconductor 12 by overcoming a masking effect of shallower positive charges that would otherwise occur in the absence of the electric field E. In other words, the external electric field E induced and maintained via field applicator 50 facilitates migration of deep positive charges 64, independent of the position and migration of shallower positive charges 64.

In one aspect, the dielectric layer 54 of field applicator 50 is maintained in contact with top surface 14 of photoconductor 12 during application of the field E. In one aspect, this contact is maintained by the strong attractive electric force created between the conductive layer 52 of field applicator 50 and the inner conductive layer 24 of the photoconductor 12, which pulls the dielectric layer 54 of the field applicator 50 into contact (e.g., sliding contact) against surface 14 of photoconductor 12. In one aspect, this attractive force is present even when there is no discharge of outer portion 15 of photoconductor 12.

Figure 3:
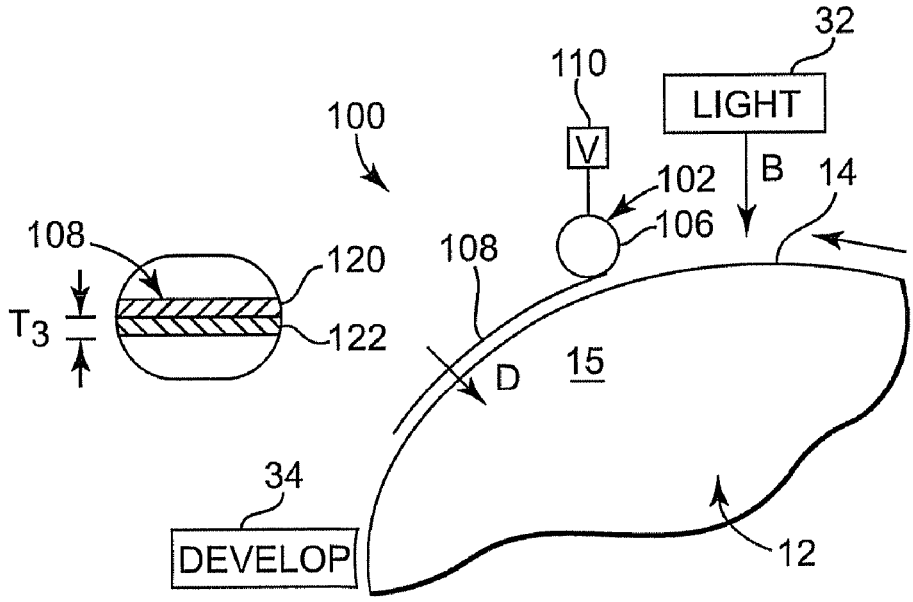
FIG. 3 is a side view illustrating an electric field applicator of an electrophotography device, according to one embodiment of the present disclosure.

FIG. 3 is a side plan view of an electrophotography device 100, according to one embodiment of the present disclosure. In one embodiment, electrophotography device comprises substantially the same features and attributes as electrophotography devices 10 and 60 as previously described and illustrated in association with FIGS. 1-2. As illustrated in FIG. 3, electrophotography device 100 comprises at least a light source 32, a development station 34, and an electric field applicator 102. In one embodiment, electric field applicator 102 comprises an anchor 106 and a conductive sheet 108 extending outward from anchor 106 to extend along top surface 14 of outer portion 15 of photoconductor 12. As further illustrated in the enlarged sectional view of conductive sheet 108, conductive sheet 108 comprises conductive foil 120 and dielectric layer 122 connected to conductive foil 120. The conductive sheet 108 is arranged to interpose insulating dielectric layer 122 between conductive foil 120 and outer surface portion 15 of photoconductor 12, thereby electrically isolating conductive foil 120 from the charged top surface 14 of photoconductor 12 (to substantially prevent conductive foil 120 from depositing charges on the photoconductor 12). A voltage source 110 in communication with conductive foil 120 provides a voltage to conductive foil 120 for application to outer portion 15 of photoconductor 12 in a manner consistent with the relationships previously described in association with FIG. 2.

Once energized, the conductive foil 120 induces an electric field E in the charge transport layer 20 (shown in FIG. 2) to draw positive charges 64 toward the top surface of outer portion 15 of photoconductor 12. In one aspect, once the voltage is applied to the conductive foil 120, conductive sheet 108 tends to be pulled into contact against rotating photoconductor 12 (as represented by directional arrow D), thereby insuring that field applicator 50 is in sufficiently close proximity to top surface 14 of photoconductor 12 to induce the electric field in outer portion 15 of photoconductor 12.

In one aspect, dielectric layer 122 of conductive sheet 108 of field applicator 102 comprises a thickness (T3), which is substantially the same as a thickness (T1) of the dielectric portion 21 of outer portion 15 of photoconductor 12 (including charge generation layer 22 and charge transport layer 20), as previously described in association with FIGS. 1-2.

In a manner substantially the same as previously described for electrophotography devices 10 in association with FIGS. 1-2, electric field applicator 102 substantially reduces a relaxation time for photoconductor 12 (between light source 32 and development station 34) while using less energy from light source 32. Among other previously described benefits, electric field applicator 102 also promotes more uniform discharging for sharper images and increases the longevity of a photoconductor.

Figure 4:
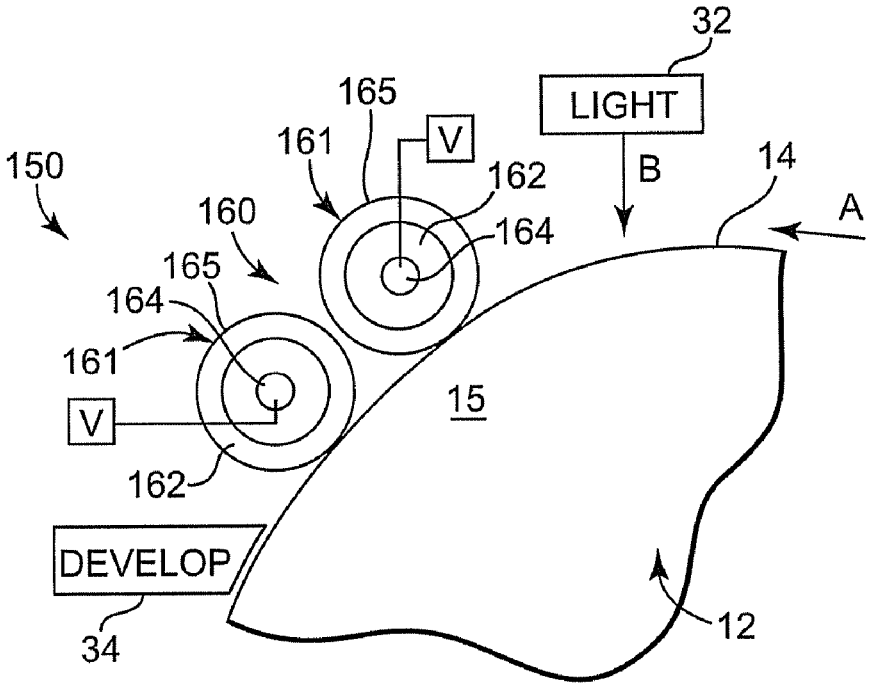
FIG. 4 is a side view illustrating an electric field applicator of an electrophotography device, according to one embodiment of the present disclosure.

FIG. 4 is a side plan view of an electrophotography device 150, according to one embodiment of the present disclosure. In one embodiment, electrophotography device 150 comprises substantially the same features and attributes as electrophotography device 10 as previously described and illustrated in association with FIGS. 1-2. As illustrated in FIG. 4, device 150 comprises light source 32, development station 34, and electric field applicator 160. In one embodiment, electric field applicator 160 comprises one or more rollers 161 in rolling contact against top surface 14 of outer portion 15 of photoconductor 12. Each roller 161 comprises a metal shaft 164 (e.g., a cylindrical shaft), a relatively thick conductive layer 162, and an outer generally thin, insulating dielectric layer 165. In one embodiment, the conductive layer 162 is formed of a soft, sponge-like material and/or rubber material to insure a large surface contact area between each respective roller 161 and top surface 14 of photoconductor 12. The conductive layer 162 of each respective roller 161 is coupled to a high voltage power source (as represented by V). In one aspect, the conductive layer 162 of each respective roller 161 induces the electric field E (FIG. 2) in the charge transport layer 20 of the photoconductor 12 while the outer dielectric layer 165 of each respective roller 161 comprises an insulating member that electrically isolates the conductive layer 162 of each respective roller 161 from the charged outer portion 15 of photoconductor 12 (to substantially prevent conductive layer 162 from depositing charges on the photoconductor 12).

In one embodiment, device 150 comprises a single, generally larger roller 161. In another embodiment, device 150 comprises a plurality of generally smaller rollers 161 aligned in series to extend about a portion of the circumference of the outer portion 15 photoconductor 12. In another aspect, multiple rollers 161 are used instead of a single roller to maximize the amount of surface area in rolling contact against the outer surface 14 of photoconductor 12 while simultaneously minimizing the height of the rollers 161 relative to outer portion 14 of photoconductor 12. This latter aspect contributes to reducing the overall size or volume of the electrophotography device 150.

Figure 5:
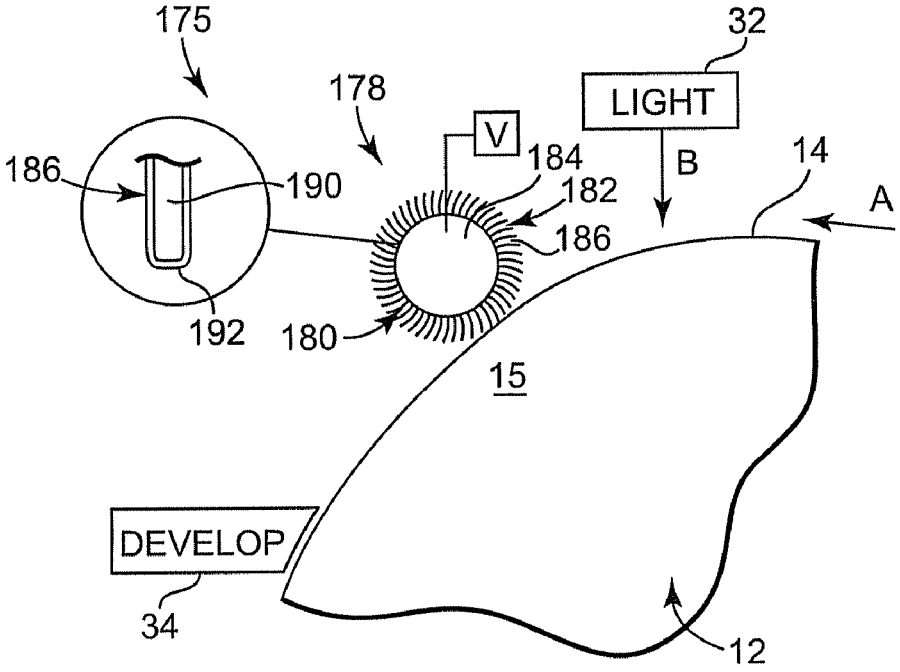
FIG. 5 is a side view illustrating an electric field applicator of an electrophotography device, according to one embodiment of the present disclosure.

FIG. 5 is a side plan view of an electrophotography device 175, according to one embodiment of the present disclosure. In one embodiment, electrophotography device 175 comprises substantially the same features and attributes as electrophotography device 10 as previously described and illustrated in association with FIGS. 1-2. As illustrated in FIG. 5, device 175 comprises light source 32, development station 34, and electric field applicator 178. In one embodiment, electric field applicator 178 comprises one or more brushes 180 in rolling contact or sliding contact against top surface 14 of outer portion 15 of photoconductor 12. Each brush 180 comprises a conductive core 184 (e.g., a cylinder) and an array 182 of filaments 186 extending radially outward from the conductive core 184. The conductive core 184 of each brush 180 is connected to a high voltage power source (as represented by V). In one aspect, the array 182 of filaments 186 acts to provide a generally continuous and high surface contact area between each respective brush 180 and top surface 14 of outer portion 15 of photoconductor 12.

As illustrated in the enlargement, each filament 186 comprises a conductive core 190 (extending from conductive core 186) and an outer dielectric layer 192 surrounding the conductive core 190. The conductive core 190 in the array of filaments 186 induces the electric field in the charge transport layer 20 of the photoconductor 12 while the outer dielectric layer 192 comprises an insulating member that electrically isolates the conductive core 190 of each filament 186 from the outer portion 15 of photoconductor 12 (to substantially prevent conductive core 190 from depositing charges on photoconductor 12).

In one embodiment, device 175 comprises a single, generally larger brush 180. In another embodiment, in a manner substantially similar to the multiple rollers 160,161 of device 150 as previously described in association with FIG. 4, device 175 comprises a plurality of generally smaller brushes 180 with the number of brushes 180 selected to maximize the amount of surface area in rolling contact and/or sliding contact against top surface 14 of outer portion 15 of photoconductor 12.

Figure 6:
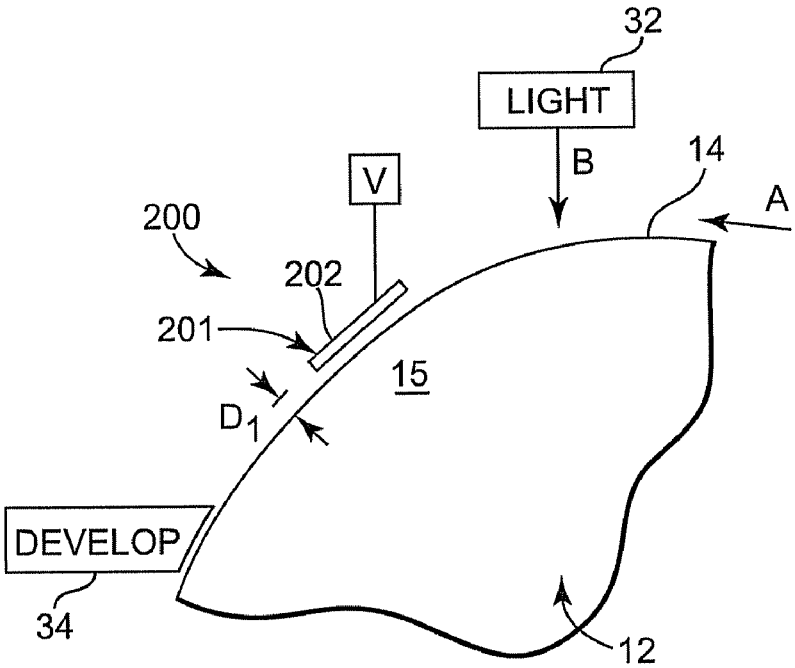
FIG. 6 is a side view illustrating an electric field applicator of an electrophotography device, according to one embodiment of the present disclosure.

FIG. 6 is a side plan view of an electrophotography device 200, according to one embodiment of the present disclosure. In one embodiment, electrophotography device 200 comprises substantially the same features and attributes as electrophotography device 10 as previously described and illustrated in association with FIGS. 1-2. As illustrated in FIG. 6, device 200 comprises light source 32, development station 34, and electric field applicator 201. In one embodiment, electric field applicator 201 comprises one or more metal electrodes 202 held in a fixed position in close proximity to, but spaced apart from, top surface 14 of outer portion 15 of photoconductor 12 (as represented by the distance D1). In one aspect, the metal electrode 202 is connected to a high voltage power source (as represented by V) and induces an electric field (E in FIG. 2) in the charge transport layer 20 of the photoconductor 12. In one aspect, the voltage applied to the metal electrode 202 is maintained in range low enough to avoid air breakdown, which potentially would cause the metal electrode 202 to act as a corona to recharge previously discharged areas of the outer portion 15 of photoconductor 12.

In one embodiment, device 200 comprises a single, generally larger electrode 202. In another embodiment, device 200 comprises a plurality of generally smaller electrodes 202. In one embodiment, metal electrode 202 has a generally straight shape while in another embodiment, metal electrode 202 has a generally curved shape arranged to substantially match a curvature of outer portion 14 of photoconductor 12.

Figure 7:
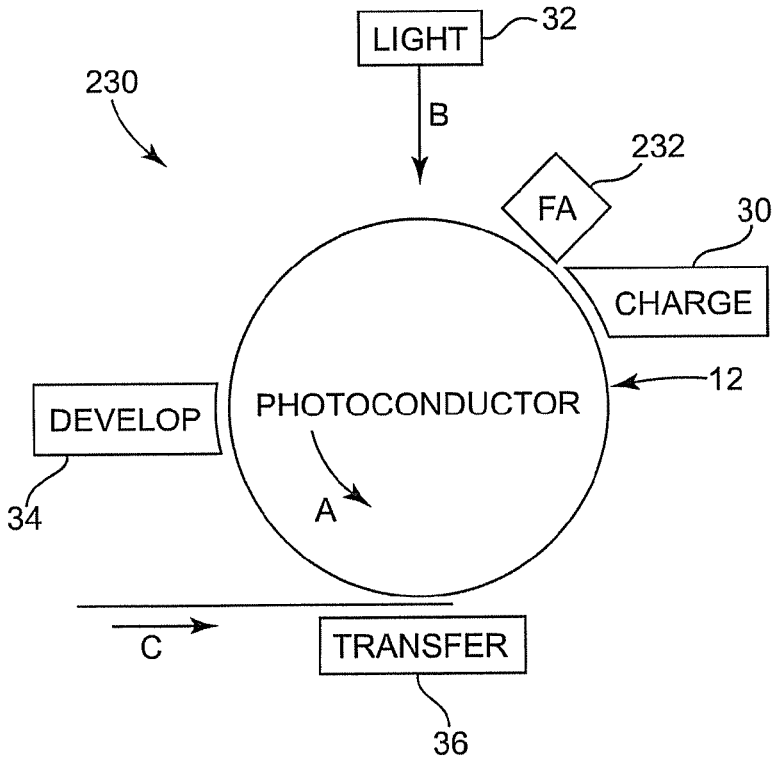
FIG. 7 is a side view illustrating an electric field applicator of an electrophotography device, according to one embodiment of the present disclosure.

FIG. 7 is a side plan view of an electrophotography device 230, according to one embodiment of the present disclosure. In one embodiment, electrophotography device 230 comprises substantially the same features and attributes as electrophotography devices as previously described and illustrated in association with FIGS. 1-6, except with a field applicator 232 positioned between charging station 30 and light source 32 instead of being positioned between light source 32 and development station 34. Accordingly, in one embodiment, the field applicator 232 is implemented in a manner substantially the same as one of the electrophotography devices 100, 150, 175, 200 as previously described in association with FIGS. 3-6, respectively, except with field applicator 232 having the location illustrated in FIG. 7.

In one aspect, a charge transport layer 20 of outer portion 14 of photoconductor 12 of electrophotography device 230 is formed with a capacitance sufficient (via its relaxation time) to sustain the electric field induced by the field applicator 232 during and after exposure to light source 32.

Figure 8:
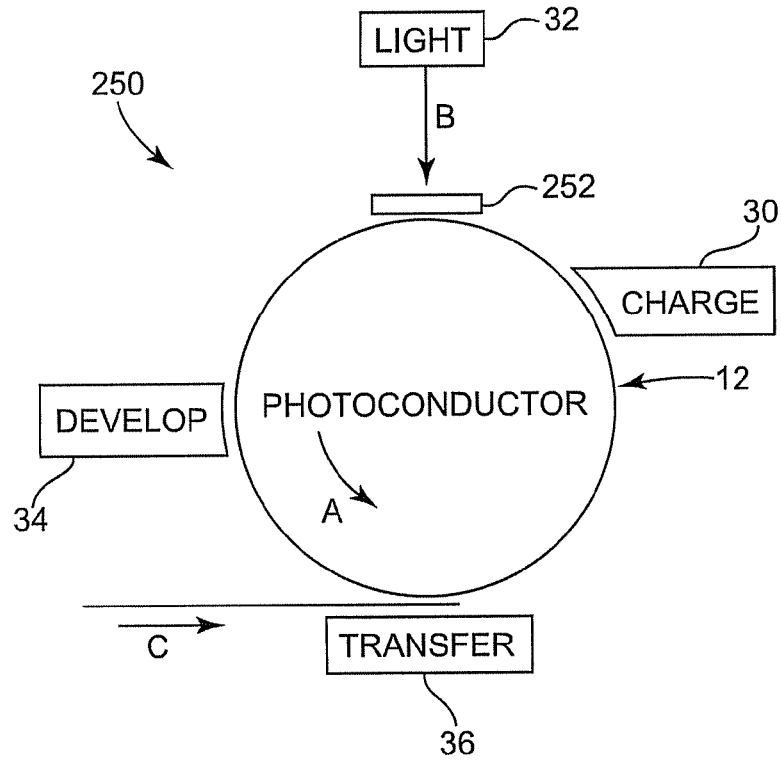
FIG. 8 is a side view illustrating an electric field applicator of an electrophotography device, according to one embodiment of the present disclosure.

FIG. 8 is a side plan view of an electrophotography device 250, according to one embodiment of the present disclosure. In one embodiment, electrophotography device 250 comprises substantially the same features and attributes as electrophotography devices as previously described and illustrated in association with FIGS. 1-6, except with a field applicator 252 positioned between directly underneath light source 32 instead of being positioned between light source 32 and development station 34 as in the embodiment illustrated in FIG. 3. In one aspect, field applicator 252 enables inducing and maintaining the electric field within outer portion 15 of photoconductor 12 during the exposure from the light source 32.

Figure 9:
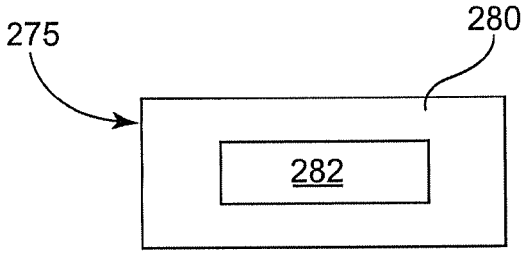
FIG. 9 is a top plan view illustrating an electrode of an electric field applicator of an electrophotography device, according to one embodiment of the present disclosure.

Accordingly, in one embodiment, the field applicator 252 is implemented in a manner substantially the same as one of the metal electrode of electrophotography device 200 as previously described in association with FIG. 6, respectively, except with field applicator 252 having the location illustrated in FIG. 8 and except with field applicator 252 being sized and shaped to accommodate light exposure from light source 32 through field applicator 252. In one embodiment, field applicator 252 comprises a metal electrode 275, as illustrated in FIG. 9, including element 280 that defines a window 282. As illustrated in FIG. 8, metal electrode 275 is positioned underneath light source 32 to permit a beam of light (as represented by B) to pass through window 282 while element 280 (FIG. 9) induces the electric field in the outer portion 15 of photoconductor 12.

In another embodiment, field applicator 252 having the location illustrated in FIG. 8 (with the beam B of light impinging on photoconductor 12) is implemented in a manner substantially the same as the field applicator 108 of electrophotography device 100 as previously described in association with FIG. 3. However, in this instance, the conductive sheet 108 of field applicator 252 is configured to be transparent to permit light emitted from light source 32 to pass through the conductive sheet 108 of field applicator 252. In one embodiment, the generally transparent field applicator 252 is positioned relative to light source 32 to permit a beam of light (as represented by B) to pass through field applicator 252 while field applicator 252 induces the electric field in the outer portion 15 of photoconductor 12.

Figure 10:
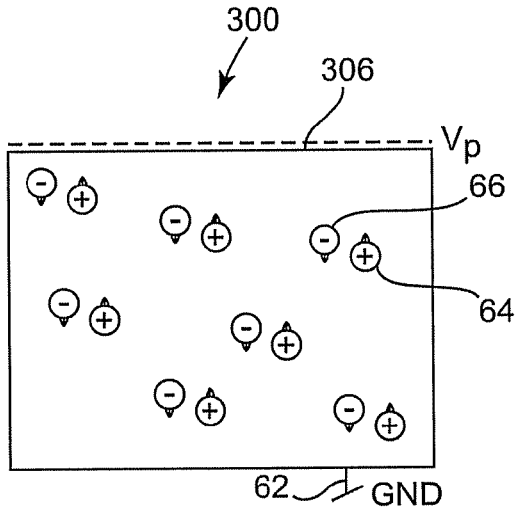
FIG. 10 is a diagram of a photoconductor of an electrophotography device, according to one embodiment of the present disclosure.

FIG. 10 is a diagram of photoconductor 300 of an electrophotography device, according to one embodiment of the present disclosure. In one embodiment, photoconductor 300 is employed in an electrophotography device that comprises substantially the same features and attributes as the electrophotography devices as previously described and illustrated in association with FIGS. 1-9, except with photoconductor 300 comprising a generally single-layered photoconductor instead of a dual layered photoconductor, such as photoconductor 12 of FIG. 2. Accordingly, in one embodiment, upon impingement of light (e.g., from light source 32 in FIG. 3), photoconductor 300 creates charge pairs 63 including a positive charge 64 (i.e., hole) and negative charge 66. The positive charges 64 move toward top surface 306 of photoconductor 300 (at which negative voltage potential Vp is located) while the negative charges 66 move toward ground 62.

In one embodiment, application of a field applicator (as in the embodiments described in association with FIGS. 1-9) induces an externally controlled electric field (E in FIG. 2) to rapidly bring the positive charges 64 to the top surface 306 of photoconductor 300. The field applicator dramatically reduces the transit time for the positive charges 64 to migrate to top surface 306 of photoconductor 300, thereby reducing the relaxation time for an electrophotography device. Of course, like the embodiments previously described in association with FIGS. 1-9, this externally applied electric field E (FIG. 2) increases the number of positive charges 64 reaching top surface 306 of photoconductor 300 to produce a sharper exposure of the latent image, as well as using less energy to discharge photoconductor 300 with a light source (e.g., light source 32).

Figure 11:
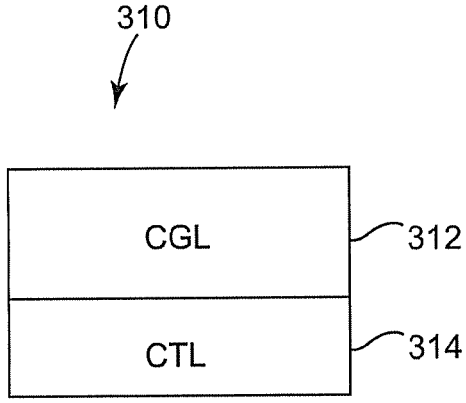
FIG. 11 is a block diagram of a photoconductor of an electrophotography device, according to one embodiment of the present disclosure.

FIG. 11 is a diagram of a photoconductor 310 of an electrophotography device, according to one embodiment of the present disclosure. In one embodiment, photoconductor drum 310 is employed in an electrophotography device that comprises substantially the same features and attributes as the electrophotography devices as previously described and illustrated in association with FIGS. 1-9, except with photoconductor 310 comprising a generally dual-layered photoconductor having a charge generation layer 312 disposed outside a charge transport layer 314. As in the embodiments described in association with FIGS. 1-9, implementing an external field applicator at an outer portion of photoconductor 310 induces an electric field to decrease a transit time and increase a transit volume of components of charge pairs, to thereby reduce a relaxation time of the photoconductor 310 of an electrophotography device.

Embodiments of the present disclosure are directed to electrophotography devices tuned to facilitate a faster response from a charged photoconductor. In one embodiment, a field applicator is positioned between a charging station and a development station to provide a substantially uniform electric field in an outer portion of a photoconductor. This arrangement drives components of a charge pair to a surface of the outer portion of the photoconductor to substantially decrease a transit time for the charge components (e.g. a positive hole). This arrangement substantially reduces the relaxation time of the photoconductor, while simultaneously using less energy, and producing sharper images from the electrophotography devices. These effects, in turn, facilitate smaller sized electrophotography devices by permitting smaller light sources and smaller photoconductors.

Although specific embodiments have been illustrated and described herein, it will be appreciated by those of ordinary skill in the art that a variety of alternate and/or equivalent implementations may be substituted for the specific embodiments shown and described without departing from the scope of the present disclosure. This application is intended to cover any adaptations or variations of the specific embodiments discussed herein. Therefore, it is intended that the claimed subject matter be limited by the claims and the equivalents thereof.

What is claimed is:

1. A method of electrophotography comprising:

charging a photoconductive element to cause a first voltage potential at a surface of an outer portion of the photoconductive element;

exposing the charged photoconductive element to a light source to form a latent image on the photoconductive element;

developing the latent image on the photoconductive element; and augmenting, prior to developing the latent image, migration of charge elements within the photoconductive element toward the surface of the outer portion of the photoconductive element via applying and substantially maintaining a second voltage potential, in addition to the first voltage potential of the charged photoconductive element, directly at the surface of the outer portion of the photoconductive element as the photoconductive element moves, wherein the first voltage potential and the second voltage potential both have the same sign voltage.

2. The method of claim 1, comprising:

performing the augmenting of the migration of charges prior to the exposing of the photoconductive element.

3. The method of claim 1, comprising:

performing the augmenting of the migration of charges after the exposing of the photoconductive element.

4. The method of claim 1, wherein causing the second voltage potential comprises:

providing an applicator that includes a dielectric portion; and positioning the dielectric portion in releasable contact against the surface of the outer portion of the photoconductive element as the photoconductive element moves.

5. The method of claim 4, comprising:

arranging the applicator to include a conductive element connected to a power source and interposing the dielectric portion between the conductive element and the photoconductive element.

6. The device of claim 1, wherein both the first and second voltage potential comprise a negative voltage potential.

7. A method of electrophotography, comprising:

exposing a photoconductive element to a light source to form a latent image on the photoconductive element;

developing the latent image on the photoconductive element; and augmenting, prior to developing the latent image, migration of charge elements within the photoconductive element toward a top surface of the photoconductive element, including performing the augmenting of the migration of charges at substantially the same location as the exposing of the photoconductive element.

8. An electrophotography device comprising:

a photoconductor;

a charging station configured to charge the photoconductor;

a light source configured to expose a latent image via partially discharging the charged photoconductor;

a developing mechanism configured to develop the latent image on partially discharged photoconductor; and an electric field applicator interposed between the charging station and the developing mechanism and configured to externally apply an electric field to the photoconductor to draw charge elements within the photoconductor to an outer surface of the photoconductor, wherein the electric field applicator includes a dielectric portion and is configured to maintain the dielectric portion in releasable contact against the outer surface of the photoconductor during movement of the photoconductor.

9. The device of claim 8, wherein the electric field applicator is positioned between the light source and the developing mechanism.

10. The device of claim 8, wherein the electric field applicator is positioned between the light source and the charging station.

11. An electrophotography device comprising:

a photoconductor;

a charging station configured to charge the photoconductor;

a light source configured to expose a latent image via partially discharging the charged photoconductor;

a developing mechanism configured to develop the latent image on partially discharged photoconductor; and an electric field applicator interposed between the charging station and the developing mechanism and configured to externally apply an electric field to the photoconductor to draw charge elements within the photoconductor to a surface of an outer portion of the photoconductor, wherein the electric field applicator comprises a metal electrode spaced apart from the surface of the outer portion of the photoconductor by a distance sufficiently close to induce the electric field in the photoconductor.

12. The device of claim 11 wherein the metal electrode includes an inner window and the metal electrode is positioned directly between the light source and the photoconductor to enable light from the light source to pass through the inner window of the metal electrode and onto the photoconductor.

13. An electrophotography device comprising:

a photoconductor;

a charging station configured to charge the photoconductor;

a light source configured to expose a latent image via partially discharging the charged photoconductor;

a developing mechanism configured to develop the latent image on partially discharged photoconductor; and an electric field applicator interposed between the charging station and the developing mechanism and configured to externally apply an electric field to the photoconductor to draw charge elements within the photoconductor to a surface of an outer portion of the photoconductor, wherein the electric field applicator comprises:

a conductive element connected to a power source and configured to apply the electric field; and a dielectric element interposed between the conductive element and the photoconductor.

14. The device of claim 13 wherein the photoconductor comprises a dielectric layer, and wherein the dielectric element of the electric field applicator has a thickness substantially the same as a thickness of the dielectric layer of the photoconductor.

15. The device of claim 13 wherein the conductive element comprises a conductive foil.

16. The device of claim 15 wherein the conductive element is positioned directly between the light source and the photoconductor, and wherein conductive foil is transparent.

17. The device of claim 13 wherein the electric field applicator comprises at least one roller and wherein the conductive element comprises a conductive core and the dielectric element defines an outer surface of the roller.

18. The device of claim 13 wherein the electric field applicator comprises at least one brush including a plurality of filaments wherein each filament includes an inner portion comprising the conductive element and an outer portion comprising the dielectric layer.

19. The device of claim 13 wherein the photoconductor comprises a generally homogeneous charge generating layer.

20. An electrophotography device comprising:

a photoconductor, wherein the photoconductor comprises a dielectric portion and a conductive layer, and wherein the dielectric portion comprises an outer charge transport layer and an inner charge generating layer with the inner charge generating layer interposed between the conductive layer and the outer charge transport layer;

a charging station configured to charge the photoconductor;

a light source configured to expose a latent image via partially discharging the charged photoconductor;

a developing mechanism configured to develop the latent image on partially discharged photoconductor; and an electric field applicator interposed between the charging station and the developing mechanism and configured to externally apply an electric field to the photoconductor to draw charge elements within the photoconductor to a surface of the outer charge transport layer of the photoconductor.

21. An electrophotography device comprising:

means for causing a first voltage potential at an outer surface of a photoconductive element;

means for forming a latent image on the photoconductive element;

means for developing the latent image after a relaxation period; and means for reducing the relaxation period via applying and substantially maintaining a second voltage potential, in addition to the first voltage potential, at the outer surface of the photoconductive element.

22. An electrophotography device comprising:

means for forming a latent image on a photoconductive element;

means for developing the latent image after a relaxation period; and means for applying an electric field to the photoconductive element to reduce the relaxation period, wherein the means for applying the electric field comprises:

a conductive element connected to a power source and configured to apply the electric field; and a dielectric element interposed between the conductive element and the photoconductor.

23. The electrophotography device of claim 22 wherein the means for applying the electric field is interposed between the means for forming the latent image and the means for developing.

24. The electrophotography device of claim 22 wherein the means for applying the electric field is positioned prior to the means for forming the latent image.

* * * * *